US005720174A

United States Patent [19]

Gorinas et al.

[11] Patent Number: 5,720,174

[45] Date of Patent: Feb. 24, 1998

[54] SECONDARY PUMP UNIT

[75] Inventors: Guy Gorinas, Sillingy; Rainer Mathes, Annecy; Alain Ravex; Jean-Marc Poncet, both of Grenoble, all of France

[73] Assignee: Alcatel Cit, Paris, France

[21] Appl. No.: 724,865

[22] Filed: Oct. 3, 1996

[30] Foreign Application Priority Data

Oct. 4, 1995 [FR] France ..... 95 11660

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 4,815,303 | 3/1989 | Duza | 62/55.5 |
| 5,062,271 | 11/1991 | Okumura et al. | 62/55.5 |
| 5,335,505 | 8/1994 | Ohtani et al. | 62/6 |
| 5,483,803 | 1/1996 | Matte et al. | 62/55.5 |
| 5,548,964 | 8/1996 | Jinbo et al. | 62/55.5 |

FOREIGN PATENT DOCUMENTS

| | | |
|---|---|---|
| 0397051A1 | 11/1990 | European Pat. Off. . |
| 0610666A1 | 8/1994 | European Pat. Off. . |
| 658291 | 3/1994 | Japan . |

OTHER PUBLICATIONS

Ravex et al, "Experimental Study and Modelisation of a Pulse Tube Refrigerator", *Cryogenics*, vol. 32, 1 Jan. 1992, pp. 9–12.

*Primary Examiner*—Ronald C. Capossela

*Attorney, Agent, or Firm*—Sughrue, Mion, Zinn, Macpeak & Seas, PLLC

[57] ABSTRACT

A secondary pump unit comprising a mechanical secondary pump and a cryogenic trap, wherein the cryogenic trap forms a ring surrounding the outside of the mechanical secondary pump at its intake end, and the trap is enclosed in a casing defining, in parallel, the intake opening of the mechanical pump and of the cryogenic trap.

6 Claims, 2 Drawing Sheets

SECONDARY PUMP UNIT

The present invention relates to a secondary pump unit.

BACKGROUND OF THE INVENTION

In numerous industrial fields, manufacturing processes are performed under a gaseous atmosphere that is at very low pressure, requiring the enclosure in which the industrial process takes place to be pumped out thoroughly. This applies, for example, to the semiconductor industry, to vacuum deposition, and to other industrial processes.

It frequently happens that the gases pumped out contain gases that are condensable, in particular water vapor, so it is a known practice to associate a cryogenic trap with a mechanical secondary pump. Such a trap is disposed on the enclosure in parallel with the mechanical secondary pump, or else in series with the pump, upstream from its suction inlet.

The cryogenic trap is cooled by a cryogenic temperature generator operating on the Gifford-McMahon or Stirling principle. The cycle is implemented by means of a moving piston. A cryogenic temperature generator is also known which is of the so-called pulsed-tube type which has the advantage of including no moving piston and which therefore is not the cause of any vibration, and is simple and cheap in structure. Such a generator comprises a compressor, a rotary valve providing pressure alternations, a heat exchanger-regenerator constituting a thermal inertial mass, a pulsed tube including a hot end and a cold end, and a buffer volume connected to the pulsed tube via a valve and serving to adjust the phase of the gas pressure in the tube relative to the speed of displacement of the gas along the tube in which pressure waves occur. The cold end of the pulsed tube is intimately bonded to the heat conducting surface that acts as the cryogenic trap.

A cryogenic temperature generator of that type is described in the article entitled "Experimental study and modelization of a pulse tube", pages 9 to 12 of Volume 21, ICEC Supplement to the Journal Cryogenics, published in 1992.

OBJECTS AND SUMMARY OF THE INVENTION

An object of the invention is to provide a secondary pump unit associated with a cryogenic trap and having smaller bulk than the above-mentioned solutions for given pumping speed performance.

The invention thus provides a secondary pump unit associating a mechanical secondary pump with a cryogenic trap, wherein said cryogenic trap forms a ring surrounding the outside of the mechanical secondary pump at its intake end, said trap being enclosed in a casing defining, in parallel, the intake opening of the mechanical pump and of the cryogenic trap.

In a preferred embodiment, the section of said trap surrounding the mechanical pump is U-shaped, with the open portion thereof being directed towards the intake end.

According to another embodiment of the invention, said cryogenic trap is cooled by a cryogenic temperature generator of the type having a pulsed tube surrounding the pump beneath said trap.

BRIEF DESCRIPTION OF THE DRAWINGS

An embodiment of the invention is described below by way of example with reference to the accompanying drawings, in which.

DETAILED DESCRIPTION OF THE PREFERRED EMBODIMENTS

Figure 1:
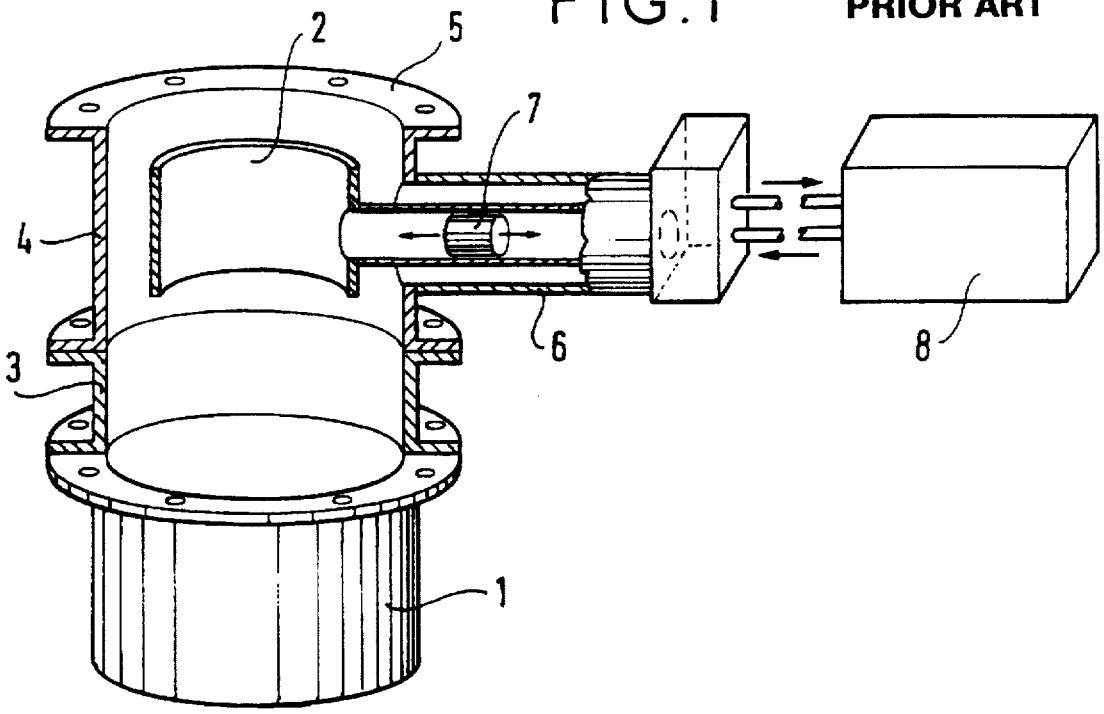
FIG. 1 PRIOR ART
FIG. 1 is a diagrammatic view showing a secondary pump unit associating a mechanical secondary pump with a cryogenic trap in a prior art disposition.

FIG. 1 shows a pump unit associating a mechanical secondary pump 1 such as a turbomolecular pump for example in series with a cryogenic trap 2, there being a regulation valve 3 interposed between the pump 1 and the cold trap 2.

Naturally, a casing 4 surrounds the cold trap 2 and includes a flange 5 for connecting the assembly to a chamber that is to be evacuated (not shown) in which an industrial process is to be performed, e.g. the manufacture of semiconductor components. The trap 2 is cooled by a cryogenic temperature generator 6 of the type having a moving piston 7 and a compressor 8.

This arrangement provides conductance between the pumping chamber and the suction inlet of the turbomolecular pump, thereby reducing the effective pumping speed of the turbomolecular pump.

Figure 2:
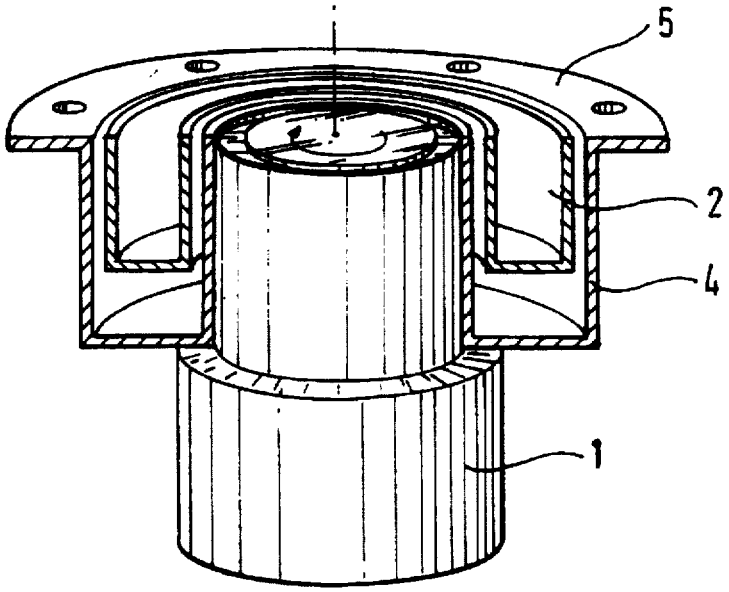
FIG. 2 is a diagrammatic view showing a secondary pump unit of the invention.

FIG. 2 shows an embodiment of the present invention. In this case, the mechanical secondary pump 1 is associated with a cryogenic trap 2 which surrounds the intake end of the pump. Advantageously, the trap 2 has a section that is U-shaped with its open portion facing towards the intake. The trap is contained in a casing 4 that has a coupling flange 5. The casing 4 defines in parallel the intake opening of the assembly constituted by the mechanical pump 1 and the cold trap 2. This means that no conductance is added between the chamber being pumped out and the turbomolecular pump 1. For a given performance level, the volume of the assembly is reduced. In addition, this disposition avoids any danger of pieces of ice falling into the mechanical pump 1.

The cryogenic temperature generator for cooling the trap 2 may be identical to that shown in FIG. 1, however it is advantageous to use a cryogenic temperature generator of the pulsed-tube type, as mentioned above, because of its simplicity and absence of a moving piston, thereby avoiding any vibration.

Figure 3:
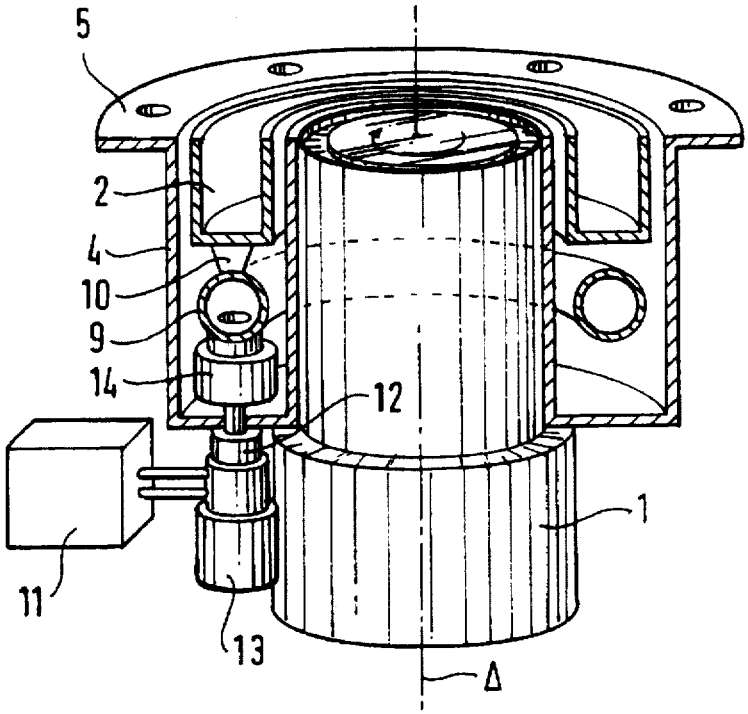
FIG. 3 is a view similar to FIG. 2 but in which a particular cryogenic temperature generator is shown diagrammatically serving to cool the cryogenic trap.

Also, according to another embodiment of the invention, and as shown in FIG. 3, the pulsed-tube type cryogenic temperature generator may have its pulsed tube 9 disposed to surround the mechanical pump 4 and situated beneath the trap 2. The cold end of the pulsed tube 9 is fixed to the trap 2 via a heat-conducting piece 10.

This arrangement reduces bulk. In addition, the pulsed tube 9 is fed by a compressor 11 via a rotary valve 12 driven by a motor 13, and via a heat exchanger-regenerator 14. To reduce bulk even further, the heat exchanger-regenerator 14, the rotary valve 12, and its drive motor 13 are in alignment parallel to the axis A of the pump.

Figure 4:
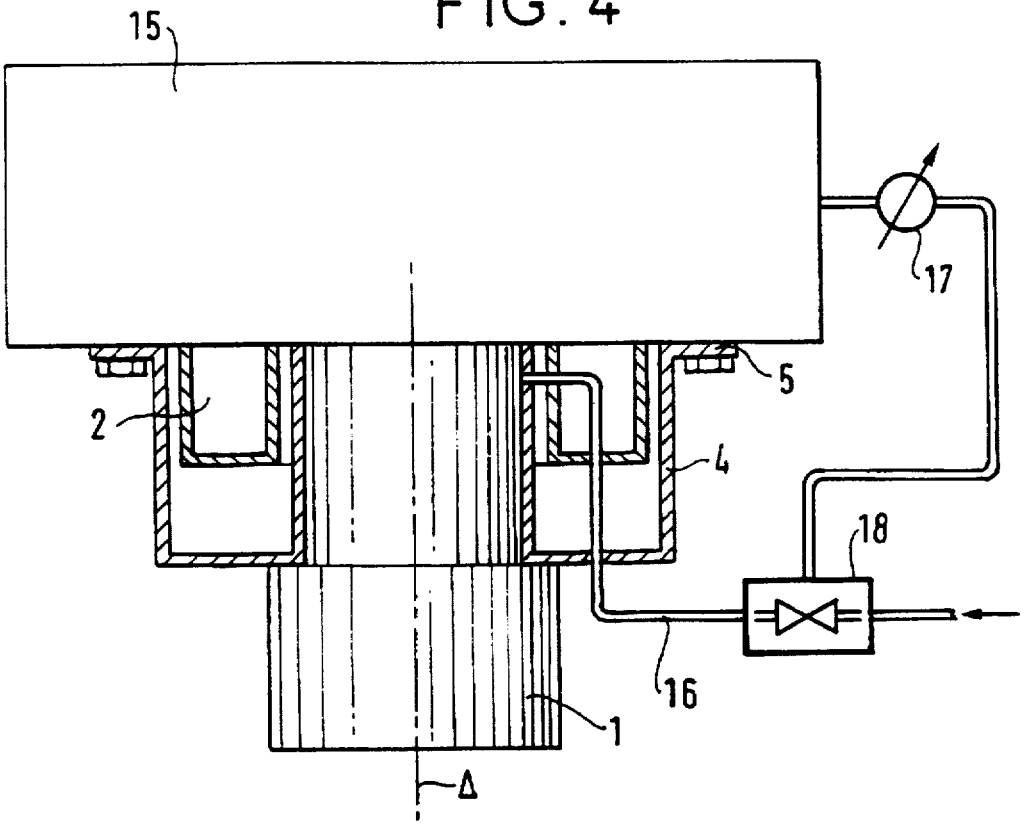
FIG. 4 shows a unit of the invention connected to a vacuum chamber and including a pressure regulator device.

Finally, FIG. 4 shows a device for regulating pressure in a chamber 15 that is to be pumped out and that is connected to the pump unit. Such regulation is performed in the prior art by a valve 3 (see FIG. 1) situated between the pump 1 and the trap 2. In the invention, this regulation is provided by injecting an inert gas, e.g. argon, into the mechanical secondary pump 1. For this purpose, a feed duct 16 terminating at the inlet of the pump is fed with gas. A pressure gauge 17 measures the pressure inside the chamber 15 and is connected to a flow rate regulator 18.

We claim:

1. A secondary pump unit comprising:

a mechanical secondary pump having an intake end;

a cryogenic trap surrounding the outside of said mechanical secondary pump at said intake end; and a casing enclosing said trap and defining, in parallel, an intake opening of said mechanical pump and of said cryogenic trap.

2. A secondary pump unit according to claim 1, wherein said trap surrounding said mechanical pump is U-shaped, and disposed with the open portion thereof directed towards said intake end.

3. A pump unit according to claim 1, wherein said cryogenic trap is cooled by a cryogenic temperature generator of the type having a pulsed tube surrounding said mechanical pump beneath said trap.

4. A pump unit according to claim 3, wherein said pulsed tube is fed by a compressor via an impedance and a heat exchanger-regenerator.

5. A pump unit according to claim 4, wherein said impedance is a rotary valve driven by a motor, and said heat exchanger-regenerator, said rotary valve, and said motor are in alignment parallel to the axis of said mechanical pump, beneath a cold end of said pulsed tube.

6. A secondary pump unit according to claim 1, wherein said secondary pump unit is connected to a chamber in which an industrial process takes place, and wherein, to ensure pressure regulation within the chamber, an inert gas is injected into the pump, the flow rate of said injection being regulated by a flow rate regulating means as a function of the pressure measured in the chamber.

* * * * *